US008303390B2

(12) United States Patent
Naicker

(10) Patent No.: US 8,303,390 B2
(45) Date of Patent: Nov. 6, 2012

(54) METHODS AND DEVICES FOR MULTI-STATE CARD GAMES WITH CARD REPLACEMENT

(75) Inventor: Theo Naicker, Durban (ZA)

(73) Assignee: Cork Group Trading Ltd., Tortola (VG)

( * ) Notice: Subject to any disclaimer, the term of this patent is extended or adjusted under 35 U.S.C. 154(b) by 460 days.

(21) Appl. No.: 12/580,607

(22) Filed: Oct. 16, 2009

(65) Prior Publication Data

US 2011/0092261 A1 Apr. 21, 2011

(51) Int. Cl.
*A63F 1/00* (2006.01)

(52) U.S. Cl. ..... 463/11; 463/12; 463/13; 463/25; 463/42; 273/292

(58) Field of Classification Search ..... 463/11, 463/12, 13, 25, 42; 273/274, 292
See application file for complete search history.

(56) References Cited

U.S. PATENT DOCUMENTS

| | | | | |
|---|---|---|---|---|
| 5,704,835 | A | 1/1998 | Dietz, II | |
| 5,947,822 | A * | 9/1999 | Weiss | 463/13 |
| 6,416,407 | B1 | 7/2002 | Carrico et al. | |
| 7,393,278 | B2 | 7/2008 | Gerson et al. | |
| 2003/0155715 | A1* | 8/2003 | Walker et al. | 273/292 |
| 2005/0026665 | A1 | 2/2005 | Gerrard et al. | 463/13 |
| 2005/0059451 | A1 | 3/2005 | Shackleford | |
| 2005/0209001 | A1 | 9/2005 | Moshal | |
| 2006/0149561 | A1 | 7/2006 | Govender | |
| 2007/0155460 | A1 | 7/2007 | Burnside et al. | |
| 2007/0262528 | A1 | 11/2007 | McKee | 273/293 |

OTHER PUBLICATIONS

"Two Plus Two Poker Forums—Poll: Should anonymity be allowed in Rush Poker," p. 1 of 2, downloaded from the World Wide Web at http://forumserver.twoplustwo.com/28/internet-poker/poll-shold-anonymity-allowed-rush-poker-694741/, on Jan. 29, 2010.
"Two Plus Two Poker Forums—Poll: Should anonymity be allowed in Rush Poker?," p. 2 of 2, downloaded from the World Wide Web at http://forumserver.twoplustwo.com/28/internet-poker/poll-shold-anonymity-allowed-rush.poker-694741/, on Jan. 29, 2010.
David Benefield : Poker Blog, "Multiaccounting," Sep. 12, 2008, CardRunners Blog Network, downloaded from the World Wide Web at http://blogs.cardrunners.com/davidb/Multiaccounting.

* cited by examiner

*Primary Examiner* — Peter DungBa Vo
*Assistant Examiner* — Damon Pierce
(74) *Attorney, Agent, or Firm* — McDonnell Boehnen Hulbert & Berghoff LLP

(57) ABSTRACT

Players in a multi-state card game, such as blackjack or baccarat, are presented with opportunities to exchange their cards for new cards when the card game is in one or more particular states. These opportunities may include offers to redeal the player's hand of cards or redeal the player's opponent's hand of cards. Additionally, when the player is dealt a new card to be added to the player's hand, the player may be offered options to discard the new card, replace the new card with another new card, or to redeal the player's hand and/or the opponent's hand. In this way, the player may be able to improve his or her position in the card game. At the same time, the game provider may charge the player for acceptance of these offers, thus improving the profit margin of the game provider.

44 Claims, 8 Drawing Sheets

OPPONENT'S HAND 110

PLAYER'S HAND 210

METHODS AND DEVICES FOR MULTI-STATE CARD GAMES WITH CARD REPLACEMENT

CROSS-REFERENCE TO RELATED APPLICATIONS

This application is entitled to the benefit of the co-pending patent application entitled "Methods and Devices for Card Games with Card Replacement," with listed inventor Theo Naicker, filed on the same date as this application, and hereby incorporated by reference in its entirety.

BACKGROUND

In various types of multi-state card games, such as but not limited to blackjack and baccarat, a player competes against an opponent. For purposes of example, the player may be human and the opponent may be a dealer who plays on behalf of a "house" (e.g., a game provider such as a casino). These card games are typically played in hands, where each hand involves an initial number of cards being dealt from a deck to each participant. The cards that each participant holds during a hand may be referred to as the participant's hand, and cards may be added to or taken away from each participant's hand during the course of the hand.

The popularity of such card games is based in part on the strategy involved in playing the game, as well as the player being able to risk money or some other form of currency on the outcome of each hand. The possibility of gain and the risk of loss tend to make these games exciting and enjoyable. Nonetheless, for each type of multi-state card game, there are certain combinations of cards that result in a weak hand. When dealt such a hand, more often than not the player will lose to his or her opponent. Being dealt a weak hand reduces the player's level of excitement, as the player's optimal strategy may be to minimize losses rather than to maximize gains. The house that provides a card game usually expects a marginal profit for each hand played. Since exciting card games tend to encourage repeat play, the house profit is likely increased when the overall excitement level of a card game is enhanced.

SUMMARY

The methods and devices disclosed herein provide enhancements to multi-state card games by giving players an opportunity to improve their positions at various stages during a hand of the card game. In doing so, the players may find the overall game more enjoyable and therefore engage in additional gameplay. As a result, the house may benefit from the increased gameplay, more players and/or a higher profit margin.

In one embodiment, a player and an opponent may be engaged in a multi-state card game, such as blackjack or baccarat. The opponent may be the house (e.g., a dealer) or another player. Preferably, the player is associated with an account that stores the player's balance of credits.

After an initial wager, the player and the opponent may each be dealt a hand of cards. Depending on the rules of the game, the player may be able to view all of his or her cards, and possibly some or all of the opponent's cards as well. From any revealed cards, the player may be able to estimate the relative strength of his or her hand in comparison to the opponent's hand.

At this point, the player may be offered an opportunity to redeal the player's hand, the opponent's hand, or both. Each of these offers may be associated with a cost. For instance, the player may have to pay a first number of credits to redeal his or her hand, a second number of credits to redeal the opponent's hand, and/or a third number of credits to redeal both hands. Preferably, the cost associated with each option is based on a relative advantage to the player of performing the redeal. If the player accepts one or more of the offers, the player's account may be debited by the cost associated with the offer, and the redeal may take place. Then, with the cards redealt, the card game may continue until a winner is determined.

Some multi-state card cards involve gameplay wherein the player and/or the opponent may add or remove cards from their respective hands in order to potentially improve their chances of winning the card game. For instance, in a game of blackjack, the player may "hit" to add cards to his or her hand until he or she is either satisfied and stands, or goes bust.

Accordingly, in another embodiment, after the player adds a new card to his or her hand, the player may be offered an opportunity to modify his or her hand by discarding the new card, replacing the new card with another new card, redealing the player's hand, redealing the opponent's hand, or some combination of these offers. Again, each of these offers may be associated with a cost, and the associated costs may be based on a relative advantage to the player of accepting the offer. Similar to the first embodiment, if the player accepts one or more of the offers, the player's account may be debited by the cost associated with the accepted offer(s), and the modification may take place. Then, with the hand(s) modified, the card game may continue until a winner is determined.

These and other aspects and advantages will become apparent to those of ordinary skill in the art by reading the following detailed description, with reference where appropriate to the accompanying drawings. Further, it should be understood that the foregoing overview is merely for purposes of illustration and is not intended to limit the scope of the invention as claimed.

DETAILED DESCRIPTION

Figure 1:
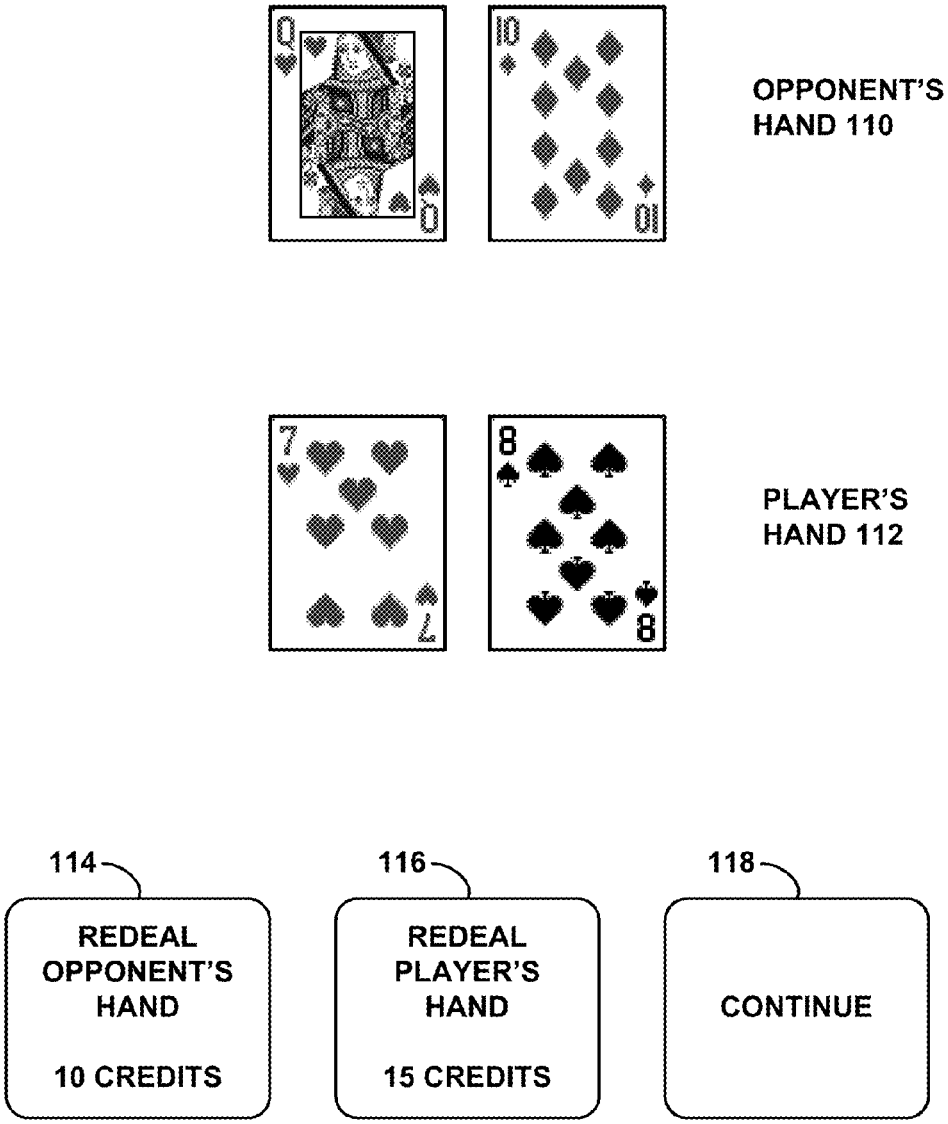
FIG. 1 is an illustration of an offer to redeal hands in a multi-state card game, in accordance with an example embodiment.

Multi-state card games that enable players to redeal their hand, their opponent's hand, or to discard or replace a drawn card are disclosed. Thus, a player of these games may be able to, at a cost, improve his or her hand. By providing these features, a house may craft a gaming environment in which players are more likely to remain engaged throughout their gaming sessions, while providing additional revenue opportunities for the house. The card games disclosed here may be played by humans, either as a table game or via a computer medium. Alternatively, the card games may be played by a human against a computer opponent, or by two computers.

In order to facilitate wagering and granting returns to players, a player may establish an account. The account may be managed either by the house or a third party. The player may load the account with a number of credits, and may wager these credits on the outcome of these card games. Such credits may be or may represent a denomination of money, a representation of money, or items of value that may be exchanged for money. Alternatively, the credits may represent play money and have no actual value, thus allowing players to enjoy the card game without risking actual financial loss. A player may load credits into their account via cash payment, credit card, electronic funds transfer, or some other means.

I. Game Descriptions

The embodiments herein are disclosed in the context of multi-state card games. In general, a multi-state card game may be one in which the state of a player's hand of cards may change through the course of the hand. For instance, the cards may be added to or removed from the player's hand according to the game's rules. Additionally, some cards in the player's hand may be replaced. Each time the cards in the player's hand or the opponent's hand changes, the state of the card game also changes. However, the state of the card game may change without the cards in any hand changing (e.g., cards may be drawn from a card supply and then discarded without being placed in a hand). Based on the state that the card game is in, the player and/or the opponent may be offered various gameplay options.

These multi-state card games may use a standard playing card deck of 52 cards, divided into four suits. These four suits may be, for example, clubs, diamonds, hearts, and spades, or some other type of suit may be used. Therefore, each suit may contain 13 cards, ten of which are preferably labeled from 1 (ace) to 10, and three of which are preferably face cards, such as a jack, a queen, and a king. On the other hand, non-standard playing cards may be used as well without departing from the scope of the invention. Additionally, multiple decks of 52 cards may be used as the supply of any cards drawn or dealt.

The following sections describe the play of two popular multi-state card games, blackjack and baccarat. However, the embodiments herein may be used with other types of multi-state card games, and are not limited to blackjack or baccarat. Moreover, blackjack, baccarat, and other types of multi-state card games may be played according to alternate rules and variations. For instance, these games may be played according to house rules of the game provider, or local or regional jurisdictional rules. The embodiments here may be applied to these alternate rules as well.

A. Blackjack

Blackjack, which also may be referred to as "21," is a card game in which a player competes against an opponent to assemble a hand of cards that represents a value equal to or less than 21 points. The winner may be awarded the wagers of loser and get their own wager back, or the winner may be paid according to other rules. For example, when the player wins against a house, the player may be awarded returns according to a predetermined house payout schedule (i.e., a pay table), but when the house wins it may be awarded the player's wagers.

Blackjack typically begins with the player and opponent placing any necessary wagers. Then, each is dealt a pair of cards. The player may be able to view both of his or her cards, while the player may only be able to view one card of the opponent's hand. Alternatively, the player may be able to view both or none of the opponent's cards, and the opponent may be able to view none, one, or both of the player's cards.

In blackjack, assuming a standard playing card deck, each face card may be worth 10 points, and each non-face card may be worth its labeled number of points. However, aces may take on a value of either 1 or 11, and this value is typically chosen to be that which is most advantageous to the holder of the ace. Thus, a hand consisting of a seven and a queen may be worth 17 points, while a hand consisting of a four and an ace may be worth either 5 or 15 points.

The goal of both participants may be to achieve a hand with a total value of less than or equal to 21 points. To this end, the participants may "hit" to request one or more additional cards. Each additional requested card may be added to the participant's hand. As long as the total value of the participant's hand has not exceeded 21 points, the participant may continue to hit. Once the total value of the participant's hand exceeds 21 points, the participant "busts" and loses the game. After any hit that results in the participant's hand containing 21 or fewer points, the participant may decide to stop hitting and "stand" with their hand in its present state.

A player may employ various strategies when determining whether or not to hit. For instance, if the total value of the player's hand is 11 or less, hitting can only improve the player's hand, so the player is likely to request at least one more card. However, if the total value of the player's hand is 17 or more, it is very likely that hitting will cause the player to bust. Thus, in the latter situation, the player may be less prone to hit.

Additionally, when making a decision of whether to hit, the player may take into account any cards in the opponent's hand that the player can view. For instance, if one of two cards in the opponent's hand is face up, and this face up card is a 10 or a face card, the play may assume that the total value of the opponent's hand is close to 21. Thus, in this situation, the player may hit more aggressively.

If the opponent is the house, the opponent may follow a particular set of rules when hitting. For instance, the opponent may be required to hit until the opponent's total value is 17 or higher, even if doing so would be likely to cause the opponent to bust. Accordingly, when playing against a house, the player may take such rules into account when determining whether to hit.

Assuming neither participant busts, when both participants are done hitting, the total value of each hand may be calculated. The participant with the hand of the highest value may win the hand. Before, during, or after this process, each participant's cards may be revealed to the other. In the case of a tie, each participant's wagers may be returned to that participant, or a winner may be designated by house rules. For instance, house rules may establish that an opponent playing on behalf of the house is declared winner of any tie.

B. Baccarat

Baccarat is a card game in which a player competes against an opponent to assemble a hand of cards that represents the highest value equal to or less than 9 points. Like blackjack, the winner may be awarded the wagers of loser and get their own wager back, or the winner may be paid according to other rules. For example, when the player wins against a house, the player may be awarded return according to a predetermined house payout schedule, but when the house wins it may be awarded the player's wagers.

In baccarat nomenclature, a hand dealt to a human may be referred to as the "player" hand and a hand dealt to a house may be referred to as the "bank" hand. Each participant in a game of baccarat may wager on either the "player" or the "bank" winning the hand. Thus, although the term "player" used throughout this specification typically refers to a hand controlled by a human player, in baccarat, a player may actually be wagering on the "bank" hand.

Assuming a standard playing card deck, in baccarat each face card may be worth 10 points, and each non-face card may be worth its labeled number of points. However, the total point value of a hand may be the sum of the point values of all cards in the hand, modulo 10. Thus, a hand consisting of a five and a two may be worth 7 points, a hand consisting of a seven and a queen may also be worth 7 points, and a hand consisting of three nines may also be worth 7 points.

The gameplay of baccarat has several variations. One variation, called Punto Banco (also known as North American Baccarat) is typically a game of chance, with no skill or strategy involved. A player's "decisions" may be dictated purely by the cards that the player is dealt. In another variation, Chemin de Fer, the player has choices that allow the player to apply skill and strategy to the game.

In the Punto Banco variation, two cards are dealt to the player and two cards are dealt to the opponent. If this deal results in either the player's hand or the opponent's hand having a total value of 8 or 9 points, both participants must stand, no further cards are dealt. If the player hand has a total value of 5 points or less, a third card is dealt to the player's hand, and then the player must stand.

Whether the opponent draws a third card may be based on the point value of the player's third card, as well as the total point value of the opponent's two cards. For example, the opponent may draw a third card or stand based on the rules provided in Table 1. In Table 1, an entry of D indicates that the opponent may draw, while an entry of S indicates that the opponent may stand. Thus, if the opponent's total point value is 4 and the player's third card was a 2, the opponent may draw a third card. However, if the opponent's total point value is 6 and the player's third card was a 5, the opponent may stand.

It should be understood that the opponent's third card rules encoded in Table 1 are for purposes of example, and this and other variations of baccarat may be played using other rules for determining whether an opponent draws a third card.

TABLE 1

Baccarat opponent third card rules.

| Player's | Opponent's Two Card Total | | | | | |
|---|---|---|---|---|---|---|
| Third Card | 0-2 | 3 | 4 | 5 | 6 | 7 |
| N/A | D | D | D | D | S | S |
| 1 | D | D | S | S | S | S |
| 2 | D | D | D | S | S | S |
| 3 | D | D | D | S | S | S |
| 4 | D | D | D | D | S | S |
| 5 | D | D | D | D | S | S |
| 6 | D | D | D | D | D | S |
| 7 | D | D | D | D | D | S |
| 8 | D | S | S | S | S | S |
| 9 | D | D | S | S | S | S |
| 10 | D | D | S | S | S | S |

Once both the player and the opponent stand, the total point value of the two hands are compared, and the hand with the higher value wins. In the case of a tie, several options are possible, including either the player or the opponent being designated as winner by default, or no return to either the player or the opponent.

In the Chemin de Fer variation of baccarat, two cards may be dealt to the player and two cards may be dealt to the opponent. Like the Punto Banco variation, if this deal results in either the player's hand or the opponent's hand having a total value of 8 or 9, both participants may stand, and no further cards are dealt. If the player's hand has a total value of 6 or 7, the player may stand. If the player's hand has a total value of 4 or less, a third card may be dealt to the player's hand, and then the player may stand. However, if the player's hand has a total value of 5, the player may decide whether to stand, or to draw a third card then stand. Once the player stands, the opponent has the choice of whether to draw a third card.

Similar to the Punto Banco variation, once both the player and the opponent stand, the total point value of the two hands may be compared, and the hand with the higher total point value may win. Also like Punto Banco, in the case of a tie, several options are possible. These options include either the player or the opponent being designated as winner by default, or no return to either the player or the opponent.

II. Redeal, Replace, and Discard Variants

Each of the card games described in the previous section, as well as other types of multi-state card games, may be enhanced by optional rules allowing a player to redeal the player's hand, redeal the opponent's hand, replace a drawn card, discard a drawn card, or some combination of these options. Each of these options may be associated with a cost, and the cost may be based on the relative advantage that executing the option provides to the player. By offering these options, the player's interest in the card game may remain high even if the player is dealt a weak hand.

FIG. 1 illustrates a first embodiment of the invention, as applied to the initial deal of a hand of blackjack. In FIG. 1, the opponent has been dealt a hand 110 consisting of a queen and a ten, for a total of 20 points. On the other hand, the player has been dealt a hand 112 consisting of an eight and a seven, for a total of 15 points. According to traditional blackjack rules, this hand would likely be a weak hand for the player. If the player stands, he or she will lose. However, if the player hits, it is likely that he or she will bust, and thus still lose.

In this embodiment, the player may be offered one or more ways of improving his or her odds of winning the hand. FIG. 1 illustrates the player being offered the options to redeal the opponent's hand 114 and/or redeal the player's hand 116. These options are associated with costs of 10 credits and 15 credits, respectively. The player may choose one or both of these options. If the player chooses both options, then the associated cost may be the sum of the cost for each option (i.e., 25 credits) or some other amount. The player may also choose the continue option 118 to continue playing the hand without a redeal.

If the player chooses to redeal at least one of the hands, the cards in the chosen hand may be discarded and replaced by new cards, and play may continue. The player's account may be debited the cost of the selected option. Preferably, the new cards are drawn from the same deck as was used to deal the initial two hands. Once the redeal is complete, the player may be once again presented with the options shown in FIG. 1. Thus, the player may continue to redeal either or both of the hands until he or she is satisfied with the result or has run out of credits. Alternatively, the player may be limited to no more than a given number of redeals per hand.

The representation in FIG. 1 of the opponent's hand 110, the player's hand 112, and the redeal options 114 and 116, as well as the continue option 118 may be incorporated into the play of a table game, or may be presented to the player on a computer screen. In the latter case, redeal options 114 and 116 each may be presented as a virtual button on a computer display. Through an input device such as a mouse or a touchscreen, a player may depress none, one or both buttons before depressing continue 118.

Although FIG. 1 has been described to represent a hand of blackjack, FIG. 1 could alternatively represent a hand of baccarat. Thus, after the initial cards are dealt to the player and the opponent, the player may be offered option 114 to replace the opponent's hand, option 116 to replace the player's hand, or both.

Figure 2:
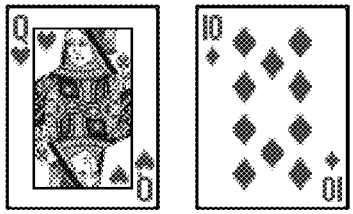
FIG. 2 is an illustration of offers to redeal a players hand, or to replace or discard a card in the player's hand in a multi-state card game, in accordance with an example embodiment.
Figure 2:
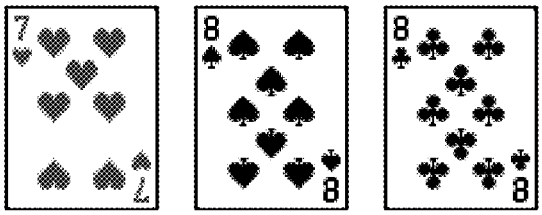
Figure 2:
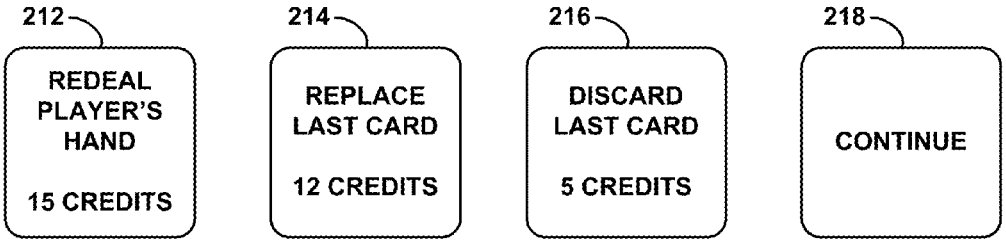

FIG. 2 illustrates a second embodiment of the present invention, also applied to a game of blackjack. FIG. 2 picks up the card game where FIG. 1 left off, assuming that the player did not accept any of the offered redeals. Thus, the card game has transitioned to a state that allowed the player to "hit." While the opponent's hand 110 remains with a score of 20, the player has "hit" and has been dealt a card that was added to his or her hand. Thus, the player's hand 210 consists of a seven and two eights, for a score of 23.

Normally, this would cause the player to bust and lose the hand. However, the second embodiment provides options with which the player can potentially improve his or her hand. In particular, the player may be offered one or more of the options shown in FIG. 2, including the redeal player's hand option 212, the replace last card option 214, and the discard last card option 216. Although an option to replace the opponent's hand is not shown in FIG. 2, such an option may also be offered to the player. Of course, the player may also be offered the continue option 218, with which the player continues the hand using the card that was dealt.

If the player chooses the redeal player's hand option 212, all of the cards in the player's hand may be discarded and replaced. In one form of this option, the player's hand may be replaced by two cards, and in another form of this option, the player's hand may be replaced by the same number of cards that were discarded. If the player chooses the replace last card option 214, the player's most recently drawn card may be replaced with a different card drawn from the deck. If the player chooses the discard last card option 216, the player's most recently drawn card may be discarded without replacement.

Once the redeal, replacement, or discard is complete, the player may be once again presented with the options shown in FIG. 2. Thus, the player may continue to redeal, replace, or discard cards in his or her hand until he or she is satisfied with the result or has run out of credits. Alternatively, the player may be limited to no more than a given number of redeals, replacements, or discards per hand.

Like the representation of FIG. 1, the representation in FIG. 2 of the opponent's hand 110, the player's hand 210, the redeal player's hand option 212, the replace last card option 214, and the discard last card option 216, as well as the continue option 218 may be incorporated into the play of a table game, or may be presented to the player on a computer screen. In the latter case, the redeal player's hand option 212, the replace last card option 214, and the discard last card option 216 each may be presented as a virtual button on a computer display. Through an input device such as a keyboard, keypad, set of buttons, mouse, or touchscreen, a player may depress none, one or both button before depressing the continue option 218.

Similar to FIG. 1, FIG. 2 has been described to represent a hand of blackjack. However, FIG. 2 could alternatively represent a hand of baccarat. Thus, after the player draws a third card but before the opponent has an opportunity to draw a third card, the player may be offered the options shown in FIG. 2.

Note that, for purposes of example, all cards in the opponent's hand are face up in FIGS. 1 and 2, and thus viewable by the player. However, in a typical game of blackjack or baccarat one or all of the opponent's cards may be placed face down instead, and may be known to the opponent but not viewable by the player. Accordingly, the multi-state card games discussed herein may include variations in which zero or more of the opponent's cards are face up or face down. Furthermore, when a player accepts an offer to redeal the opponent's hand, these variations may either redeal just the opponent's face up cards, just the opponent's face down cards, or all of the opponent's cards.

III. Calculating Costs

As discussed above, regardless of whether the game being played is blackjack, baccarat, or some other multi-state card game, each of the options illustrated in FIGS. 1 and 2 may be associated with a cost to the player. Preferably, the cost of an offer is proportional to the expected gain that acceptance of the offer will provide the player.

Thus, for example, if a blackjack player is holding a weak hand, as shown in FIGS. 1 and 2, the cost associated with an offer to exchange the cards in that hand may be relatively high. However, if the player is holding a hand with a better chance of winning than the pictured weak hands, the cost associated with an offer to exchange the cards in this better hand may be relatively low. Furthermore, if the player is holding a hand that is likely to beat the opponent's hand, the cost associated with an offer to exchange the cards in such a strong hand may be negative or zero. In this way, the house can encourage a player to accept an offer that is likely to lower the strength of the player's hand.

The following blackjack scenario provides an example of how the cost of an offer may be calculated. Assume that a blackjack game is played with a single deck of cards and that the participants wager 100 credits per hand. Assume further that the player's cards are an ace and a 9 and the opponent's hand is showing an ace and also contains a face down card. Without a redeal option, the optimal move for the player may be to stand. Assume, for purposes of this example, standing would result in an expected return of 113 credits for the player, for a profit of 13% on the 100-credit wager.

Assume again that if the player accepts an offer to redeal the opponent's ace (here it is assumed that this offer only redeals the opponent's face up card), the player's expected return rises to 161 credits. In other words, by accepting the offer to redeal the opponent's hand, the player's expected return increases from 113 to 161 credits. Thus, the true cost of the redeal to the house is 48 credits, the difference between these two expected returns. Therefore, the house may determine the cost associated with the offer to be at least 48 credits. For example, the house may include a 5% margin (rounded up) of 3 credits on the offer, thus making the cost associated with the offer 51 credits.

Suppose the player decides to redeal the player's hand instead of redealing the opponent's hand. Suppose further than such a choice will reduce the player's expected return, in the absence of any further exchanges of cards, to 61 credits. In this situation the true cost of the redeal to the house is −52 credits, the difference between 61 and 113 credits. In other words, the house expects to gain 52 credits if the player accepts the offer. Thus, it behooves the house to attempt to get the player to accept this offer. To that end, the house may associate a cost of zero with the offer, or associate a negative cost with the offer, thus "paying" the player to accept the offer. Any such negative cost should pay the player no more than 52 credits. For example, the house may again include a 5% margin (also rounded up) of 3 credits on the offer, thus paying the player 49 credits to accept the offer.

These expected returns may be calculated in a number of ways. For instance, the expected returns may be based just on the cards in the hands of the player and the opponent. However, the remaining cards in the deck may also be considered, as well as any cards that have already been discarded. The costs associated with any offers provided at each stage of the card games may be calculated dynamically, calculated based on statistical tables, or calculated based on some combination of both.

For example, with reference to acceptance of the offer to redeal the opponent's ace, the opponent will receive a new card. The probability of the opponent receiving a new card of a given rank depends on the cards that have already been dealt prior to the point of the offer to redeal. In particular, the opponent has a probability of 2/48 of being redealt an ace, as only two aces remain in the deck and four cards have been dealt from the deck of 52 cards. The cost of the redeal may then be calculated as the difference in the player's expected returns between (a) the current player and opponent hands, and (b) the average of all potential outcomes with the opponent's hand redealt.

IV. Game Playing Environments

In addition to being played as table games, the embodiments of card games described herein may be facilitated through the interconnection of computers and computer networks. The advantages of computerized gameplay include allowing the player to engage in the card games from the privacy of his or her own home, or via a mobile device from virtually anywhere.

Figure 3:
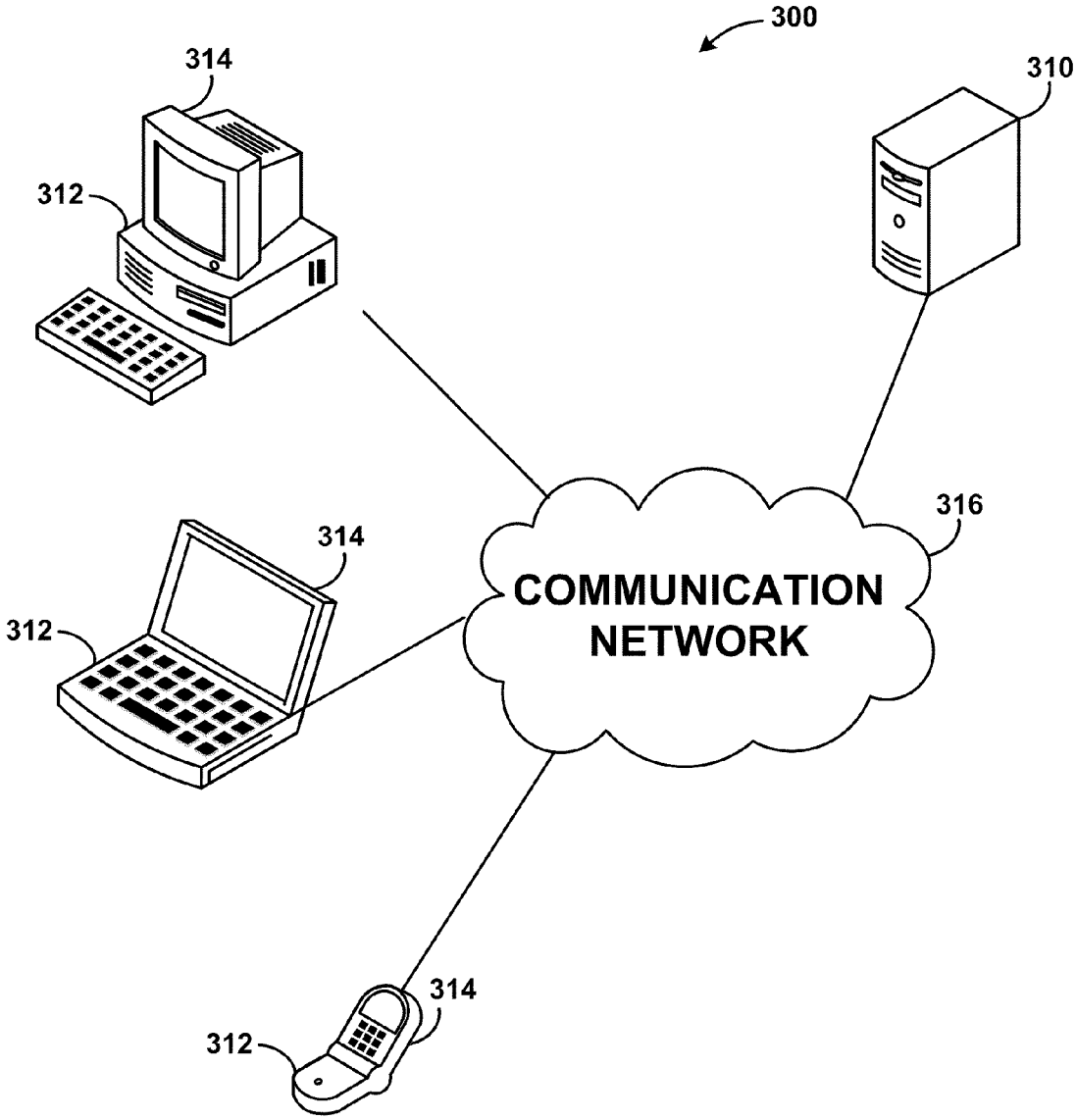
FIG. 3 is a diagram of a client/server networked computing system that may be used to facilitate play of a multi-state card game, in accordance with an example embodiment.

FIG. 3 depicts an example of such a computerized arrangement. It should be understood, however, that this and other arrangements and processes described herein are set forth for purposes of example only, and other arrangements and elements (e.g., machines, interfaces, functions, orders of elements, etc.) can be added or used instead, and some elements may be omitted altogether. Further, as in most computer and communication architectures, those skilled in the art will appreciate that many of the elements described herein are functional entities that may be implemented as discrete components or in conjunction with other components, in any suitable combination and location. For example, systems and methods for facilitating the playing of games over a communication network are described in published PCT application WO 03/093921 A2, which is incorporated by reference herein in its entirety.

In FIG. 3, the system 300 includes the gaming server 310 and the client devices 312, each client device 312 preferably having a display 314. The gaming server 310 and the client devices 312 may be capable of communicating with each other by means of the communication network 316. The communication network 316 may be a public Internet Protocol (IP) network such as the Internet, a private IP network, or a public or a private network that operates according to other communication protocols. Thus, the client devices may be, for example, personal computers, laptops, or wireless communication devices such as cell phones.

Furthermore, the communication network 316 may be purpose-built or hardcoded network designed for the support of networked games. For example, the gaming server 310 may be a mainframe computer and the client devices 312 may be terminals that only communicate with the gaming server 310. Thus, the communication network 316 may only comprise communication links between the devices they connect. Alternatively, the gaming server 310 and one or more client devices 312 may be combined into a standalone gaming machine, such as a video game console.

The client devices 312 and the gaming server 310 may include various computing technologies, such as those that are semiconductor-based, magnetic, optical, acoustic, or biological in nature, any combination of these computing technologies, or any other technology known today or developed in the future, that can be used in conjunction with computational devices. A networked game architecture may also be defined to comprise more or fewer elements. For example, the gaming server 310 may be distributed across more than one physical or logical device.

A. Server Devices

The gaming server 310 may comprise a computing device with input, output, processing, storage, and memory functions. The gaming server 310 may be a form of personal computer, or may be physically designed for server operation. For example, the gaming server 310 may be a rack-mounted or blade server component. With respect to the depiction of the gaming server 310 in FIG. 3, the gaming server 310 may actually take the form of multiple physical components or computers that are co-located or distributed. For example, the gaming server 310 may be a cluster of computing devices that operate in conjunction with one another to enable networked games. This cluster may be in a particular physical location, such as an Internet service provider (ISP), or may operate over a network between multiple physical locations.

The gaming server 310 may run a standalone or distributed operating system to enable server functions. This operating system may be based on Microsoft Windows, Apple's MacOS, Linux, FreeBSD or various other technologies. These operating systems preferably support multiple processes or threads of execution so that a single gaming server 310 can support a potentially large number of card games simultaneously. Additionally, the gaming server 310 may be provisioned with a network connection.

The gaming server 310 preferably operates under control of a server-stored program (not shown) capable of enabling the client devices 312 to participate in one or more card games. The stored program in the gaming server 310 may also maintain a dynamic register of all participants admitted to, and actively participating in, a card game, together with data representative of the corresponding card game.

Additionally, the gaming server 310 may contain, or have access to, accounts associated with each of these participants. Thus, the gaming server 310 may add credits to or debit credits from these accounts in accordance with the networked game being played. Furthermore, the gaming server 310 may have an interface from which a given participant may access his or her account in order to add more credits, or to cash out the account's credit balance. Moreover, the gaming server 310 may also have an administrative interface, from which an administrator of the gaming server 310 can add, delete, or modify accounts or game settings.

B. Client Devices

The client devices 312 may comprise personal computers, computer terminals, laptop computers, wireless communication devices such as cell phones, personal digital assistants, or similar devices. Furthermore, the client devices 312 may operate under an operating system such as Microsoft Windows, Apple MacOS, Linux or FreeBSD, and are preferably provisioned with a web browser and network connection.

Using the client device 312, networked card games may be facilitated by a client process (not shown) that executes on the client device 312, and the server-stored program (not shown), or server process, that executes on the gaming server 310. In order to play a networked game from any client device 312, a client process may first be downloaded, for example, from the gaming server 310 to the client device 312. The downloaded client process may then be installed in the client device 312, where after it is ready for execution. Alternatively, the client process may execute from within a World Wide Web browser of the client device 312. In either case, once the client process is launched, communication between the client device 312 and the gaming server 310 may then proceed.

The output functions of client devices 312 may comprise a graphical user interface (GUI) rendered on display 314. Such a GUI may represent networked game information in some combination of graphics and text. For example, a GUI on display 314 may represent the state of a card game associated with the client device 312, and include options to perform the acts of playing the card game, and, during the course of the card game, accepting or rejecting offers to redeal, replace, or discard cards. The client process executing on the client device 312 may display different trade marks, color schemes, or "look and feel" depending on the card game being played.

C. Functional Model of Gaming Servers and Client Devices

Figure 4:
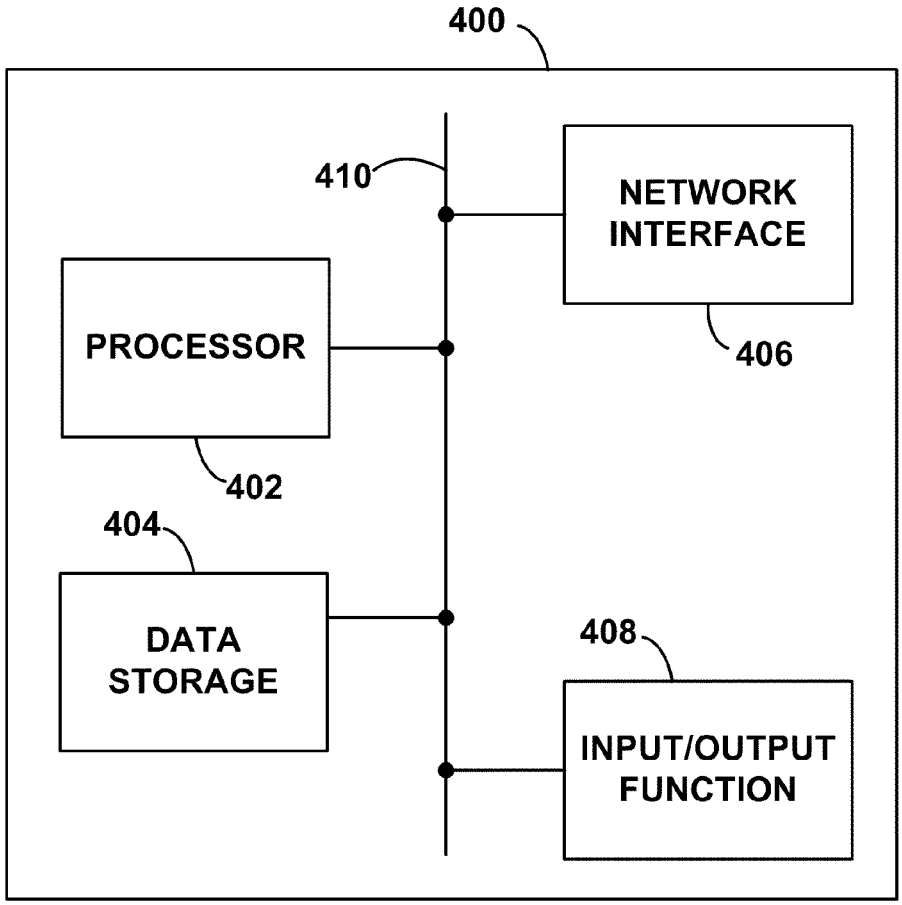
FIG. 4 is a block diagram of a computing device that may be used to execute part or all of a computerized multi-state card game, in accordance with an example embodiment.

FIG. 4 is a simplified block diagram depicting an example representation of computing device 400. Gaming servers, such as the gaming server 310, and/or client devices, such as the client device 312, may be arranged according to such an example representation. FIG. 4 illustrates some of the functional components that would likely be found in a computing device that operates in accordance with the embodiments herein. The computing device 400 preferably includes a processor 402, data storage 404, a network interface 406, and an input/output function 408, all of which may be coupled by a system bus 410 or a similar mechanism.

The processor 402 preferably includes one or more central processing units (CPUs), such as one or more general purpose processors and/or one or more dedicated processors (e.g., application specific integrated circuits (ASICs) or digital signal processors (DSPs), etc.) The data storage 404, in turn, may comprise volatile and/or non-volatile memory and can be integrated in whole or in part with the processor 402. Alternatively, part or all of the data storage 404 may be external to computing device 400, and thus may take the form of remote storage or network storage. The data storage 404 preferably holds program instructions executable by the processor 402, and data that is manipulated by these instructions, to carry out various functions described herein. Alternatively, the functions can be defined by hardware, firmware, and/or any combination of hardware, firmware and software.

By way of example, the data in the data storage 404 may contain information associated with performing any of the methods, processes, or functions described herein or represented by any of the accompanying figures. For example, the data storage 404 may contain data associated with the state of a multi-state card game, data associated with a player's account, and so on. The data storage 404 may also contain program instructions that are executable by the processor 402 to perform any of the gaming server or client device methods, processes, or functions presented herein or represented by any of the accompanying figures.

The network interface 406 may take the form of a wireline connection, such as an Ethernet, Token Ring, SONET, or T-carrier connection. The network interface 406 may alternatively or additionally take the form of a wireless connection, such as IEEE 802.11, BLUETOOTH®, CDMA, WIMAX®, UMTS®, LTE®, or any other interface used to communicate. However, other forms of physical layer connections and other types of standard or proprietary communication protocols may be used over network interface 406. Furthermore, the network interface 406 may comprise multiple physical or logical network interfaces, each capable of operating according to the same or different protocols.

The input/output function 408 facilitates user interaction with the computing device 400. The input/output function 408 may comprise multiple types of input devices, such as a keyboard, a mouse, a touch screen, and so on. Similarly, the input/output function 408 may comprise multiple types of output devices, such as a monitor, printer, or one or more light emitting diodes (LEDs). Additionally or alternatively, computing device 400 may support remote access from another device, via the network interface 406 or via another interface (not shown), such an RS-232 port.

V. Example Methods

Figure 5:
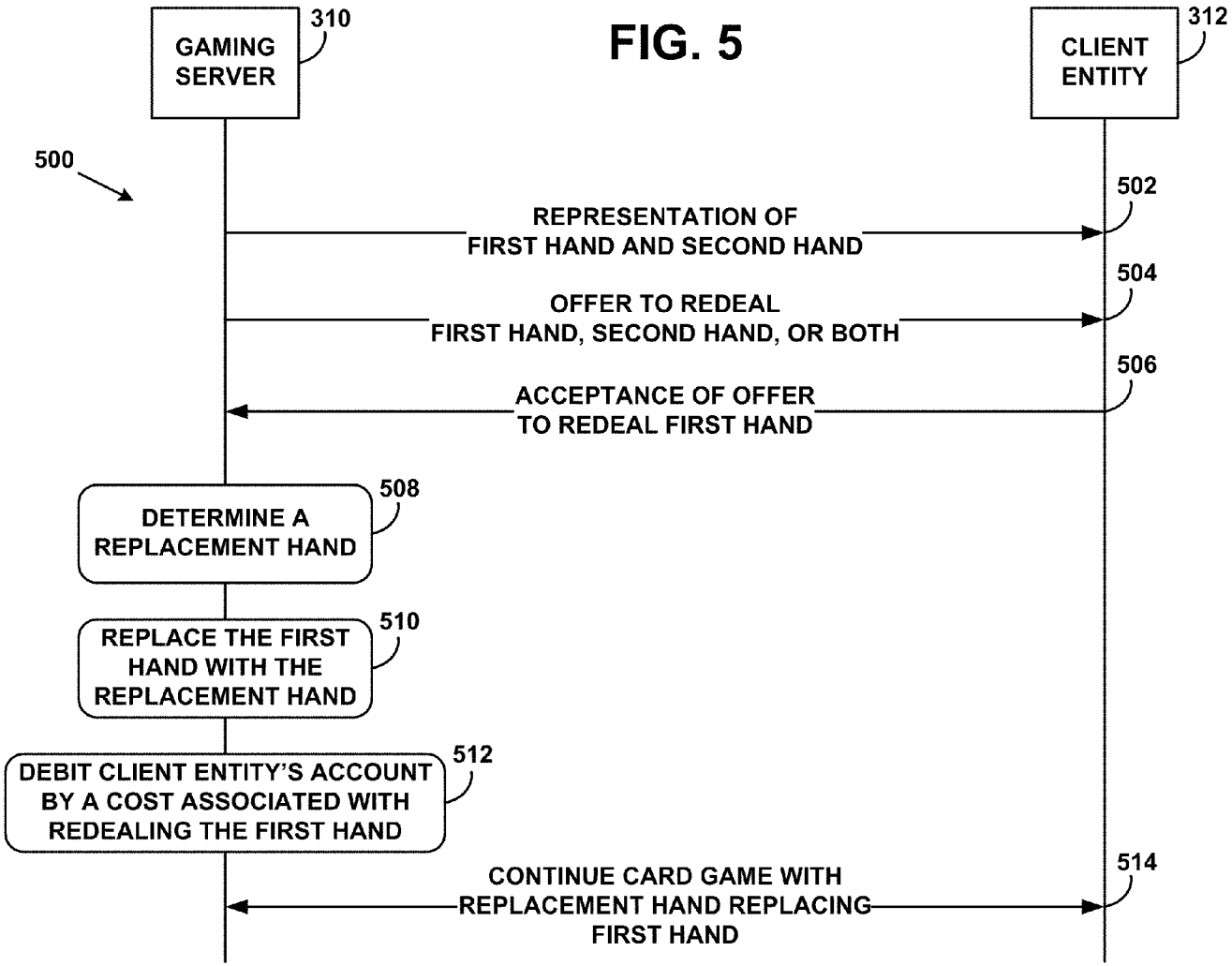
FIG. 5 is a message flow diagram, in accordance with an example embodiment.
Figure 6:
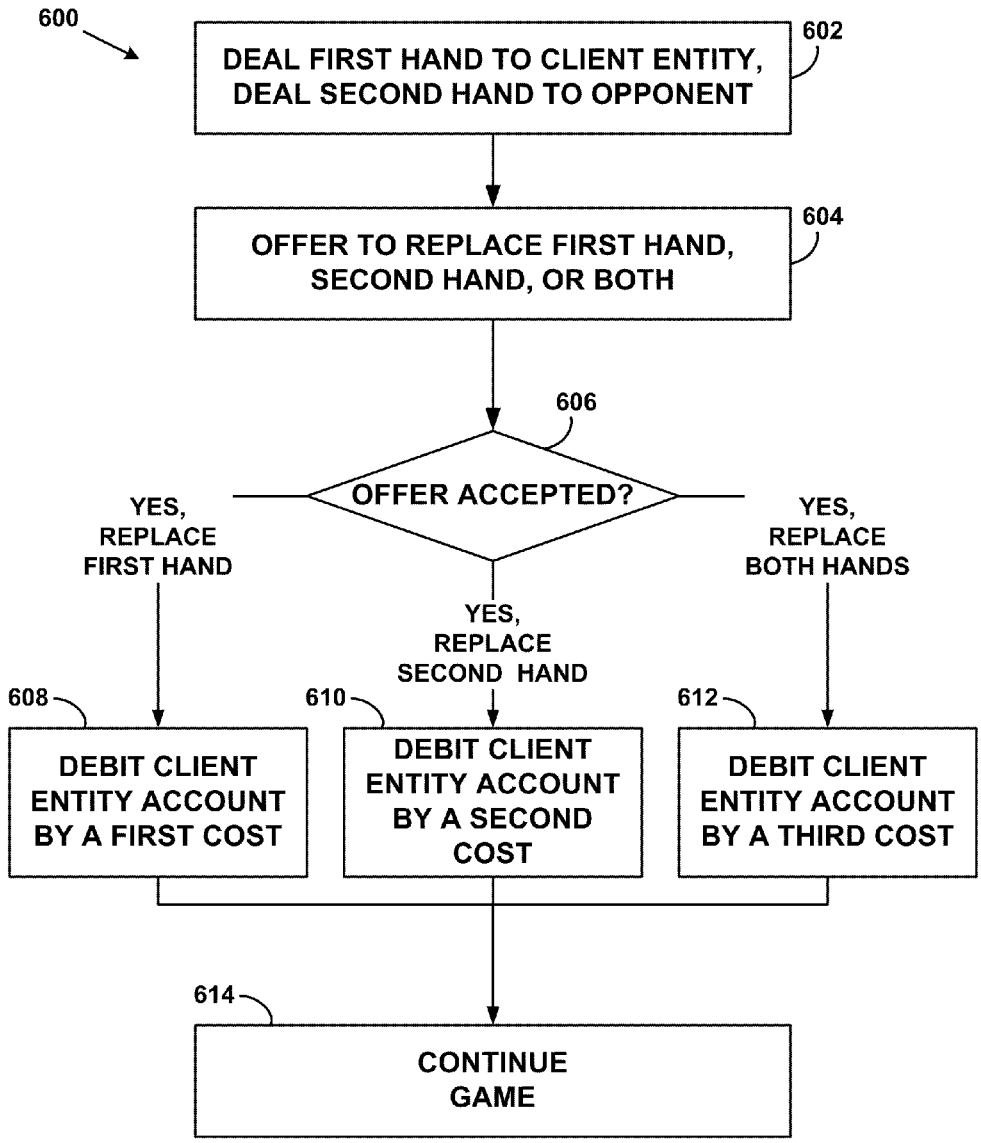
FIG. 6 is a flow chart, in accordance with an example embodiment.
Figure 7:
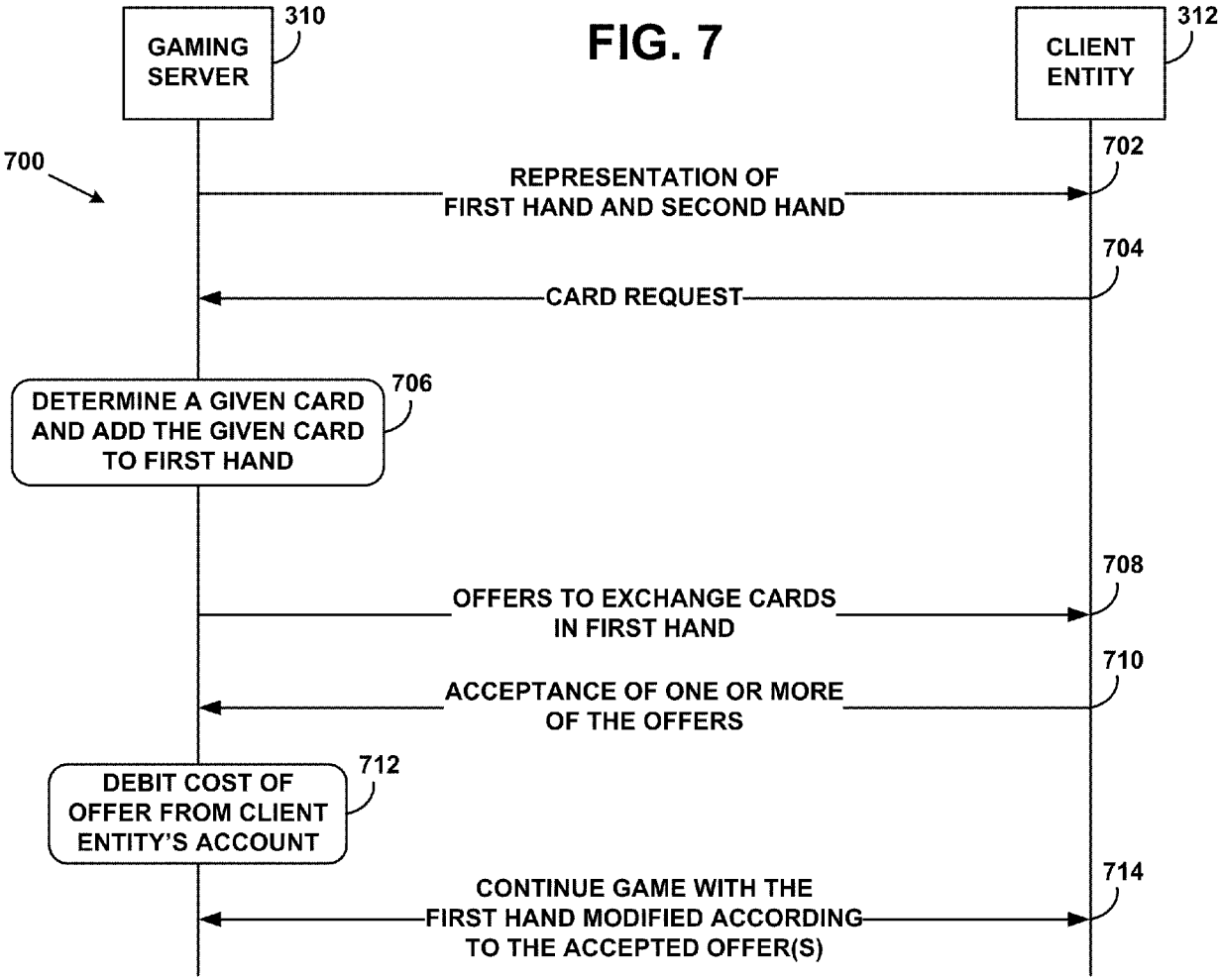
FIG. 7 is another message flow diagram, in accordance with an example embodiment.
Figure 8:
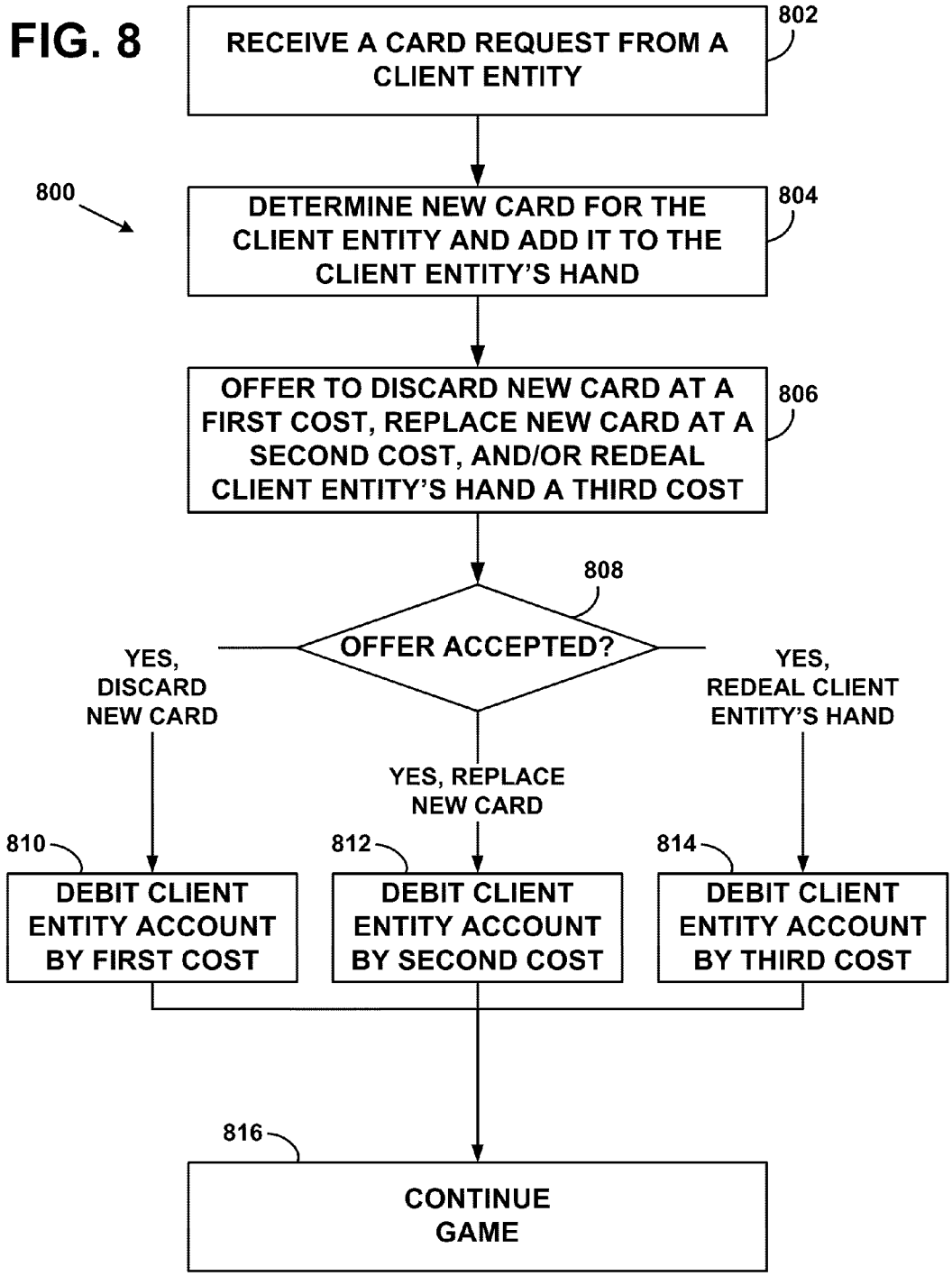
FIG. 8 is another flow chart, in accordance with an example embodiment.

FIGS. 5-8 are message flow diagrams and flow charts of methods in accordance with example embodiments of this invention. FIGS. 5 and 6 depict a gaming server offering a client entity an opportunity to exchange cards after initial hands of cards are dealt, while FIGS. 7 and 8 depict the gaming server offering the client entity an opportunity to exchange cards after the client entity has drawn an additional card. All cards dealt to a participant or drawn by a participant in such a card game are presumed to be determined randomly.

It should be understood that each of the methods illustrated by these figures may include more or fewer steps. Furthermore, the steps of any two or more of these message flow diagrams and flow charts can be combined with one another, in whole or in part, without departing from the scope of the embodiments herein. Moreover, the costs in each of the example embodiments related to FIGS. 5-8 may be determined according to any of the calculations described in Section III of this specification.

FIG. 5 depicts a message flow 500 for facilitating a redeal of a hand of cards. Message flow 500 may occur between the gaming server 310 and the client entity 312. At step 502, the gaming server 310 may provide the client entity 312 with a representation of a first hand of cards and a second hand of cards. Each of these hands may be drawn from a deck containing a fixed number of cards, for instance, a standard deck of 52 cards.

Preferably, the first hand is played by a human via the client entity 312 and the second hand is played by the gaming server 310 on behalf of a house. The card game being played may be blackjack, baccarat, or some other multi-state card game. Accordingly, there may be one or more cards in each hand. For example, in blackjack or baccarat, the first hand may contain two cards and the second hand may also contain two cards. Zero, one or both of the cards in the second hand may be revealed to the client entity.

Additionally, the client entity 312 may be associated with an account, and the account may contain some number of credits that the client entity 312 may use to wager during play of the card game.

At step 504, the gaming server 310 may provide an offer to redeal the first hand, the second hand, or both to the client entity 312. At step 506, the client entity 312 may provide acceptance of the offer to redeal the first hand. In response to receiving the acceptance, the gaming server 310 may determine a replacement hand (step 508), replace the first hand with the replacement hand (step 510), and debit the client entity's account by a first cost associated with redealing the first hand (step 512). Then, at step 514, the card game may continue with the replacement hand replacing the first hand.

In an alternative embodiment, the client entity 312 may provide acceptance of the offer to redeal the second hand. In response to receiving this acceptance, the gaming server 310 may determine a replacement hand, replace the second hand with the replacement hand, and debit the client entity's account by a second cost associated with redealing the second hand. Then, the card game may continue with the replacement hand replacing the second hand.

In another alternative embodiment, the client entity 312 may provide acceptance of the offer to redeal both hands. In response to receiving this acceptance, the gaming server 310 may determine a first replacement hand and a second replacement hand, replace the first hand with the first replacement hand and replace the second hand with the second replacement hand. Additionally, the gaming server 310 may debit the client entity's account by a third cost associated with redealing both hands. Then, the card game may continue with the replacement hands replacing the first and second hands.

In these embodiments, the replacement hand may be drawn from the same deck of cards from which the first and second hands were drawn. Furthermore, if the second hand is redealt, the replacement hand may not replace all of the cards in the second hand. For instance, the replacement hand may only replace the face up cards in the second hand.

FIG. 6 is a flow chart 600 of a method for facilitating a redeal of a hand of cards. This method may be performed by a gaming server, such as gaming server 312. At step 602, a first hand may be dealt to a client entity, and a second hand may be dealt to an opponent. At 604, the client entity may be provided with an offer to replace the first hand, the second hand, or both.

At step 606, is it determined which option (if any) of the offer was accepted. If no option was accepted (not shown), the game continues with the first hand and second hand in place. However, if the option to replace the first hand was accepted, then at step 608, the client entity's account may be debited by a first cost. Likewise, if the option to replace the second hand was accepted, then at step 610, the client entity's account may be debited by a second cost. Similarly, if the option to replace both hands was accepted, then at step 612, the client entity's account may be debited by a third cost. Then, at step 614, the card game may be continued with one or more hands replaced according to the accepted option.

FIG. 7 depicts a message flow 700, between the gaming server 310 and the client entity 312, for facilitating a redeal of a hand of cards, or a discard or replacement of a recently drawn card. At step 702, the gaming server 310 provides the client entity 312 with a representation of a first hand of cards and a second hand of cards. Each of these hands may be drawn from a deck containing a fixed number of cards, for instance, a standard deck of 52 cards.

Preferably, the first hand is played by a human via the client entity 312 and the second hand is played by the gaming server 310 on behalf of a house. The card game being played may be blackjack, baccarat, or some other multi-state card game. Accordingly, there may be one or more cards in each hand. For example, in blackjack or baccarat, the first hand may contain two cards and the second hand may also contain two cards. Zero, one or both of the cards in the second hand may be revealed to the client entity.

Additionally, the client entity 312 may be associated with an account, and the account may contain some number of credits that the client entity 312 may use to wager during play of the card game.

At step 704, the client entity may provide a card request to the gaming server 310. This card request may be a request to "hit" in blackjack, a request for a third card in baccarat, or some other type of card request. At step 706, in response to receiving the card request, the gaming server 310 may determine a given card, and add this given card to the first hand.

Then, at step 708, the gaming server 310 may provide to the client entity one or more offers to exchange cards in the first hand. For example, included may be offers to discard the given card, replace the given card with a new card, and/or to redeal the first hand. At step 710, the client entity 312 may provide acceptance of one of the offers to the gaming server 310. In response to receiving this acceptance, at step 712, the gaming server 310 may debit a cost associated with the offer (s) from the client entity's account. Then, at step 714, the card game may continue with the first hand modified according to the accepted offer(s).

FIG. 8 is a flow chart 800 of a method also for facilitating a redeal of a hand of cards, or a discard or replacement of a recently drawn card. This method may be performed by a gaming server, such as gaming server 312. Flow chart 800 presumes that the client entity has been dealt a hand of cards.

At step 802, the gaming server receives a card request from a client entity. This card request may be a request to "hit" in blackjack, a request for a third card in baccarat, or some other type of card request. At step 804, the gaming server may determine a new card for the client entity and adds the new card to the client entity's hand.

At step 806, the gaming server may provide the client entity with one or more offers. These offers may be to (i) discard the new card at a first cost, (ii) replace the new card with another card at a second cost, or (iii) redeal the client entity's hand at a third cost. Accordingly, at step 808, the gaming server may determine whether an offer has been accepted. If an offer has been accepted, the gaming server may debit the client entity's account by the first cost (step 810), the second cost (step 812), or the third cost (step 814) according to the offer accepted. Then, at step 816, the card game may be continued with the client entity's hand modified according to the accepted option.

It should be understood that client entity 312 may be physically or logically distinct from gaming server 310. Thus, client entity 312 may be a client machine that is communicatively linked to the gaming server 310 by a network. In this case, the gaming server providing information (e.g., an offer) to the client entity 312 may comprise the gaming server 310 transmitting a representation of the information through the network.

Alternatively, the client entity 312 may be physically or logically combined with the gaming server 310. Thus, the client entity 312 may be a user interface that is coupled to the gaming server 310, and the gaming server 310 providing information to the client entity 312 may comprise displaying a representation of the information on the user interface.

VI. Conclusion

For the embodiments described herein, the terms "random" or "randomly" shall refer to any realizable process of randomly generating events. Such processes shall include, but not be limited to, generating events without a deterministic pattern of occurrences. Additionally, these processes may be pseudo-random, thus resulting in a deterministic pattern of occurrences that exhibit some form of statistical randomness.

It should also be understood that use of any form of enumeration within an element of any of the claims should not be construed to imply that an ordering of events within the claim is required.

Furthermore, other variations from the disclosed embodiments may be made without departure from the scope of the invention. All questions concerning scope are to be answered by reference to the appended claims.

I claim:

1. A method for playing a card game, the method comprising:

a gaming server providing, to a client entity, an offer to replace at least a first hand of cards associated with an opponent entity, wherein the client entity is playing the card game against the opponent entity, and wherein replacing the first hand is associated with a first cost to the client entity, wherein the first cost is based on a first relative advantage of replacing the first hand with the first replacement hand;

the gaming server receiving, from the client entity, acceptance of the offer;

in response to receiving the acceptance of the offer, the gaming server (i) determining a first replacement hand, (ii) replacing at least part of the first hand with the first replacement hand, and (iii) debiting the first cost from an account associated with the client entity; and the gaming server continuing play of the card game with the first replacement hand replacing the first hand.

2. The method of claim 1, wherein the offer is also to replace a second hand of cards associated with the client entity, wherein replacing the second hand is associated with a second cost to the client entity, the method further comprising:

in response to receiving the acceptance of the offer, the gaming server also (i) determining a second replacement hand, (ii) replacing the second hand with the second replacement hand, and (iii) debiting the second cost from the account.

3. The method of claim 2, wherein the second hand consists of two cards revealed to the client entity, and wherein the second replacement hand replaces both of the two cards in the second hand.

4. The method of claim 2, wherein each of the first hand, the second hand, the first replacement hand, and the second replacement hand comprises cards from a deck containing a fixed number of cards.

5. The method of claim 1, wherein the first hand consists of one card revealed to the client entity and one card hidden from the client entity, and wherein the first replacement hand replaces only the card in the first hand that is revealed to the client entity.

6. The method of claim 1, wherein the card game is blackjack.

7. The method of claim 1, wherein the opponent entity continuing play of the card game with the first hand is associated with a first expected return, and wherein opponent entity continuing play of the card game with the first hand replaced by the first replacement hand is associated with a second expected return, and wherein the first relative advantage is based on a difference between the first expected return and the second expected return.

8. The method of claim 1, wherein the first cost is negative.

9. The method of claim 1, wherein the client entity is a client machine that is communicatively linked to the gaming server by a network, and wherein providing the offer to the client entity comprises transmitting a representation of the offer through the network.

10. The method of claim 1, wherein the client entity is a user interface coupled to the gaming server, and wherein providing the offer to the client entity comprises displaying a representation of the offer on the user interface.

11. The method of claim 1, wherein the first cost is calculated by the gaming server.

12. A method for a gaming server to conduct a multi-state card game, wherein the gaming server is communicatively coupled to a client entity, wherein the multi-state card game begins in a first state, the method comprising:

based on the gaming server determining that the card game is in the first state, the gaming server (i) generating a first hand of cards for the client entity and a second hand of cards for an opponent entity, (ii) providing a representation of the first hand and the second hand to the client entity, and (iii) determining that the card game is in a second state;

based on the card game being in the second state, the gaming server providing, to the client entity, a first offer to replace the second hand at a first cost to the client entity;

in response to receiving acceptance of the first offer, the gaming server (i) generating a first replacement hand of cards, (ii) replacing the second hand with the first replacement hand, (iii) transmitting, to the client entity, an indication that the second hand has been replaced by the first replacement hand, and (iv) determining that the game is in a third state; and based on the game being in the third state, the gaming server (i) adding a new card to the second hand, and (ii) providing a second offer to change at least part of the second hand at a second cost to the client entity.

13. The method of claim 12, further comprising:

based on the card game being in the second state, the gaming server also providing, to the client entity, a second offer to replace the first hand at a second cost to the client entity; and in response to receiving acceptance of the second offer, the gaming server (i) generating a second replacement hand of cards, (ii) replacing the first hand with the second replacement hand, and (iii) transmitting, to the client entity, an indication that the first hand has been replaced by the second replacement hand.

14. The method of claim 12, wherein the client entity is associated with an account, the method further comprising:

in response to receiving acceptance of the first offer, the gaming server also debiting the first cost from the account.

15. The method of claim 12, further comprising:

in response to receiving acceptance of the second offer, the gaming server (i) generating a second replacement hand of cards, (ii) replacing the second hand with the second replacement hand, and (iii) transmitting, to the client entity, an indication that the second hand has been replaced by the second replacement hand.

16. The method of claim 12, further comprising:

in response to receiving acceptance of the second offer, the gaming server (i) replacing the new card with another new card, and (ii) providing, to the client entity, an indication that the new card was replaced with the another new card.

17. The method of claim 12, further comprising:

in response to receiving acceptance of the second offer, the gaming server (i) removing the new card from the second hand, and (ii) providing, to the client entity, an indication that the new card was removed.

18. The method of claim 12, wherein the client entity is associated with an account, the method further comprising:

in response to receiving acceptance of the second offer, the gaming server debiting the second cost from the account.

19. A gaming server communicatively coupled to a client entity and engaging the client entity in a card game, the gaming server comprising:

a processor;

an interface with which to communicate with the client entity;

a data storage containing program instructions, executable by the processor, to perform operations to:

provide, to a client entity, an offer to replace at least a first hand of cards associated with an opponent entity, wherein the client entity is playing the card game against the opponent entity, and wherein replacing the first hand is associated with a first cost to the client entity, wherein the first cost is based on a first relative advantage of replacing the first hand with the first replacement hand;

receive, from the client entity, acceptance of the offer;

in response to receiving the acceptance of the offer, (i) determine a first replacement hand, (ii) replace at least part of the first hand with the first replacement hand, and (iii) debit the first cost from an account associated with the client entity; and continue play of the card game with the first replacement hand replacing the first hand.

20. The gaming server of claim 19, wherein the offer is also to replace a second hand of cards associated with the client entity, wherein replacing the second hand is associated with a second cost to the client entity, the operations also including:

in response to receiving the acceptance of the offer, also (i) determine a second replacement hand, (ii) replace the second hand with the second replacement hand, and (iii) debit the second cost from the account.

21. The gaming server of claim 20, wherein the second hand consists of two cards revealed to the client entity, and wherein the second replacement hand replaces both of the two cards in the second hand.

22. The gaming server of claim 20, wherein each of the first hand, the second hand, the first replacement hand, and the second replacement hand comprises cards from a deck containing a fixed number of cards.

23. The gaming server of claim 19, wherein the first hand consists of one card revealed to the client entity and one card hidden from the client entity, and wherein the first replacement hand replaces only the card in the first hand that is revealed to the client entity.

24. The gaming server of claim 19, wherein the opponent entity continuing play of the card game with the first hand is associated with a first expected return, and wherein opponent entity continuing play of the card game with the first hand replaced by the first replacement hand is associated with a second expected return, and wherein the first relative advantage is based on a difference between the first expected return and the second expected return.

25. The gaming server of claim 19, wherein the first cost is negative.

26. The gaming server of claim 19, wherein the first cost is calculated by the gaming server.

27. A non-transitory computer readable medium for use in a gaming server, the medium containing program instructions, executable by the gaming server, for performing the steps of:

providing, to a client entity, an offer to replace at least a first hand of cards associated with an opponent entity, wherein the client entity is playing the card game against the opponent entity, and wherein replacing the first hand is associated with a first cost to the client entity, wherein the first cost is based on a first relative advantage of replacing the first hand with the first replacement hand;

receiving, from the client entity, acceptance of the offer;

in response to receiving the acceptance of the offer, (i) determining a first replacement hand, (ii) replacing at least part of the first hand with the first replacement hand, and (iii) debiting the first cost from an account associated with the client entity; and continuing play of the card game with the first replacement hand replacing the first hand.

28. The non-transitory computer readable medium of claim 27, wherein the offer is also to replace a second hand of cards associated with the client entity, wherein replacing the second hand is associated with a second cost to the client entity, the medium containing further program instructions, executable by the gaming server, for performing the steps of:

in response to receiving the acceptance of the offer, the gaming server also (i) determining a second replacement hand, (ii) replacing the second hand with the second replacement hand, and (iii) debiting the second cost from the account.

29. The non-transitory computer readable medium of claim 28, wherein the second hand consists of two cards revealed to the client entity, and wherein the second replacement hand replaces both of the two cards in the second hand.

30. The non-transitory computer readable medium of claim 28, wherein each of the first hand, the second hand, the first replacement hand, and the second replacement hand comprises cards from a deck containing a fixed number of cards.

31. The non-transitory computer readable medium of claim 27, wherein the first hand consists of one card revealed to the client entity and one card hidden from the client entity, and wherein the first replacement hand replaces only the card in the first hand that is revealed to the client entity.

32. The non-transitory computer readable medium of claim 27, wherein the card game is blackjack.

33. The non-transitory computer readable medium of claim 27, wherein the opponent entity continuing play of the card game with the first hand is associated with a first expected return, and wherein opponent entity continuing play of the card game with the first hand replaced by the first replacement hand is associated with a second expected return, and wherein the first relative advantage is based on a difference between the first expected return and the second expected return.

34. The non-transitory computer readable medium of claim 27, wherein the first cost is negative.

35. The non-transitory computer readable medium of claim 27, wherein the client entity is a client machine that is communicatively linked to the gaming server by a network, and wherein providing the offer to the client entity comprises transmitting a representation of the offer through the network.

36. The non-transitory computer readable medium of claim 27, wherein the client entity is a user interface coupled to the gaming server, and wherein providing the offer to the client entity comprises displaying a representation of the offer on the user interface.

37. The non-transitory computer readable medium of claim 27, wherein the first cost is calculated by the gaming server.

38. A non-transitory computer readable medium for use in a gaming server to conduct a multi-state card game, wherein the multi-state card game begins in a first state, the medium containing program instructions, executable by the gaming server, for performing the steps of:

based on the gaming server determining that the card game is in the first state, the gaming server (i) generating a first hand of cards for the client entity and a second hand of cards for an opponent entity, (ii) providing a representation of the first hand and the second hand to the client entity, and (iii) determining that the card game is in a second state;

based on the card game being in the second state, the gaming server providing, to the client entity, a first offer to replace the second hand at a first cost to the client entity;

in response to receiving acceptance of the first offer, the gaming server (i) generating a first replacement hand of cards, (ii) replacing the second hand with the first replacement hand, (iii) transmitting, to the client entity, an indication that the second hand has been replaced by the first replacement hand, and (iv) determining that the game is in a third state; and based on the game being in the third state, the gaming server (i) adding a new card to the second hand, and (ii) providing a second offer to change at least part of the second hand at a second cost to the client entity.

39. The non-transitory computer readable medium of claim 38, the medium containing further program instructions, executable by the gaming server, for performing the steps of:

based on the card game being in the second state, the gaming server also providing, to the client entity, a second offer to replace the first hand at a second cost to the client entity; and in response to receiving acceptance of the second offer, the gaming server (i) generating a second replacement hand of cards, (ii) replacing the first hand with the second replacement hand, and (iii) transmitting, to the client entity, an indication that the first hand has been replaced by the second replacement hand.

40. The non-transitory computer readable medium of claim 38, wherein the client entity is associated with an account, the medium containing further program instructions, executable by the gaming server, for performing the steps of:

in response to receiving acceptance of the first offer, the gaming server also debiting the first cost from the account.

41. The non-transitory computer readable medium of claim 38, the medium containing further program instructions, executable by the gaming server, for performing the steps of:

in response to receiving acceptance of the second offer, the gaming server (i) generating a second replacement hand of cards, (ii) replacing the second hand with the second replacement hand, and (iii) transmitting, to the client entity, an indication that the second hand has been replaced by the second replacement hand.

42. The non-transitory computer readable medium of claim 38, the medium containing further program instructions, executable by the gaming server, for performing the steps of:

in response to receiving acceptance of the second offer, the gaming server (i) replacing the new card with another new card, and (ii) providing, to the client entity, an indication that the new card was replaced with the another new card.

43. The non-transitory computer readable medium of claim 38, the medium containing further program instructions, executable by the gaming server, for performing the steps of:

in response to receiving acceptance of the second offer, the gaming server (i) removing the new card from the second hand, and (ii) providing, to the client entity, an indication that the new card was removed.

44. The non-transitory computer readable medium of claim 38, the medium containing further program instructions, executable by the gaming server, for performing the steps of:

in response to receiving acceptance of the second offer, the gaming server debiting the second cost from the account.

* * * * *